US012704270B2

(12) United States Patent
Phillips et al.

(10) Patent No.: US 12,704,270 B2
(45) Date of Patent: Aug. 11, 2026

(54) HEAT EXCHANGER ASSEMBLY FOR AN AIR CONDITIONING APPLIANCE

(71) Applicant: Haier US Appliance Solutions, Inc., Wilmington, DE (US)

(72) Inventors: Richard Michael Phillips, Goshen, KY (US); Bryan Isaac D'Souza, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 184 days.

(21) Appl. No.: 18/738,873

(22) Filed: Jun. 10, 2024

(65) Prior Publication Data

US 2025/0377119 A1 Dec. 11, 2025

(51) Int. Cl.

| | |
|---|---|
| ***F24F 1/0067*** | (2019.01) |
| ***F24F 1/06*** | (2011.01) |
| ***F24F 1/16*** | (2011.01) |
| ***F24F 13/22*** | (2006.01) |
| ***F28F 17/00*** | (2006.01) |

(52) U.S. Cl.

CPC ..... *F24F 1/0067* (2019.02); *F24F 1/16* (2013.01); *F24F 13/22* (2013.01); *F24F 13/222* (2013.01); *F28F 17/005* (2013.01); *F24F 2013/225* (2013.01)

(58) Field of Classification Search

CPC .... F24F 1/022; F24F 1/027; F24F 1/03; F24F 1/031; F24F 1/0314; F24F 1/42; F24F 1/0067; F24F 13/22; F24F 13/222; F24F 2013/225; F24F 2013/227

See application file for complete search history.

(56) References Cited

U.S. PATENT DOCUMENTS

| | | | | |
|---|---|---|---|---|
| 2,811,023 | A | 10/1957 | Lathrop | |
| 3,996,764 | A * | 12/1976 | Gilmer | F25B 40/02 62/279 |
| 5,966,958 | A * | 10/1999 | Maynard | F25D 21/14 62/277 |
| 6,065,296 | A * | 5/2000 | Feger | F24F 1/022 62/150 |
| 6,591,627 | B1 * | 7/2003 | Rollins | F25D 21/14 62/277 |
| 6,931,881 | B1 | 8/2005 | Movshovitz | |
| 7,854,141 | B1 * | 12/2010 | Breen | F24F 1/022 62/81 |
| 11,187,418 | B1 * | 11/2021 | DeLoach | F24F 13/22 |

(Continued)

FOREIGN PATENT DOCUMENTS

| | | |
|---|---|---|
| CN | 202328699 U | 7/2012 |
| CN | 210179777 U | 3/2020 |

*Primary Examiner* — Christopher R Zerphey
(74) *Attorney, Agent, or Firm* — Dority & Manning, P.A.

(57) ABSTRACT

A heat exchanger assembly for an air conditioner unit includes an indoor heat exchanger positioned within an indoor portion of the air conditioner unit, an outdoor heat exchanger positioned within an outdoor portion of the air conditioner unit, the outdoor heat exchanger comprising an outdoor coil and a plurality of heat exchange fins thermally coupled to the outdoor coil, wherein an exposed portion of the outdoor coil is not covered by the plurality of heat exchange fins, and a condensate collection pan positioned under the indoor heat exchanger for collecting condensate, wherein the condensate is directed onto the exposed portion of the outdoor coil.

20 Claims, 5 Drawing Sheets

(56) References Cited

U.S. PATENT DOCUMENTS

| | | | | |
|---|---|---|---|---|
| 11,204,180 | B2 * | 12/2021 | Kil | F24F 13/222 |
| 2013/0133351 | A1 * | 5/2013 | Kil | F24F 1/0323 62/291 |
| 2024/0068736 | A1 | 2/2024 | Real et al. | |

* cited by examiner

HEAT EXCHANGER ASSEMBLY FOR AN AIR CONDITIONING APPLIANCE

FIELD OF THE INVENTION

The present subject matter relates generally to air conditioning appliances, and more particularly to heat exchanger assemblies in air conditioning appliances.

BACKGROUND OF THE INVENTION

Air conditioner or conditioning units are conventionally utilized to adjust the temperature indoors, e.g., within structures such as dwellings and office buildings. Such units commonly include a closed refrigeration loop to heat or cool the indoor air. Typically, the indoor air is recirculated while being heated or cooled. A variety of sizes and configurations are available for such air conditioner units. For example, some units may have one portion installed indoors that is connected to another portion located outdoors, e.g., by tubing or conduit carrying refrigerant. These types of units are typically used for conditioning the air in larger spaces.

Another type of air conditioner unit, commonly referred to as single-package vertical units (SPVU) or package terminal air conditioners (PTAC), may be utilized to adjust the temperature in, for example, a single room or group of rooms of a structure. These units typically operate like split heat pump systems, except that the indoor and outdoor portions are defined by a bulkhead and all system components are housed within a single package that is installed in a wall sleeve positioned within an opening of an exterior wall of a building. In this regard, such units commonly include an indoor portion that communicates (e.g., exchanges air) with the area within a building and an outdoor portion that generally communicates (e.g., exchanges air) with the area outside a building. Accordingly, the air conditioner unit generally extends through, for example, an outer wall of the structure, or is otherwise ducted to the outdoors.

Air conditioner efficiency can be improved by utilizing evaporator condensate to cool the condenser. Conventional air conditioners utilize condensate by using a slinger ring on the outdoor fan to sling and vaporize collected water. However, the benefits of slinging condensate for evaporative cooling are limited. Moreover, slinging condensate may result in depositing water directly on the condenser while air is flowing therethrough, and the water may tend to blow off of the coil and into the outdoor environment, reducing the water that reaches the base pan to be later vaporized. In addition, slinging water directly onto the finned section of the outdoor coil may result in decreased airflow, clogging of the airflow path, and decreased heat transfer.

Accordingly, an air conditioner unit with improved efficiency would be useful. More specifically, an SPVU that is capable of utilizing condensate to improve operating efficiency would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment, an air conditioner unit defining a vertical, a lateral, and a transverse direction is provided, including a bulkhead mounted within a cabinet to define an indoor portion and an outdoor portion, an indoor heat exchanger positioned within the indoor portion, an outdoor heat exchanger positioned within the outdoor portion, the outdoor heat exchanger comprising an outdoor coil and a plurality of heat exchange fins thermally coupled to the outdoor coil, wherein an exposed portion of the outdoor coil is not covered by the plurality of heat exchange fins, and a condensate collection pan positioned under the indoor heat exchanger for collecting condensate, wherein the condensate is directed onto the exposed portion of the outdoor coil.

In another exemplary embodiment, a heat exchanger assembly for an air conditioner unit is provided. The air conditioner unit defines a vertical, a lateral, and a transverse direction and includes a bulkhead mounted defining an indoor portion and an outdoor portion. The heat exchanger assembly includes an indoor heat exchanger positioned within the indoor portion, an outdoor heat exchanger positioned within the outdoor portion, the outdoor heat exchanger comprising an outdoor coil and a plurality of heat exchange fins thermally coupled to the outdoor coil, wherein an exposed portion of the outdoor coil is not covered by the plurality of heat exchange fins, and a condensate collection pan positioned under the indoor heat exchanger for collecting condensate, wherein the condensate is directed onto the exposed portion of the outdoor coil.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
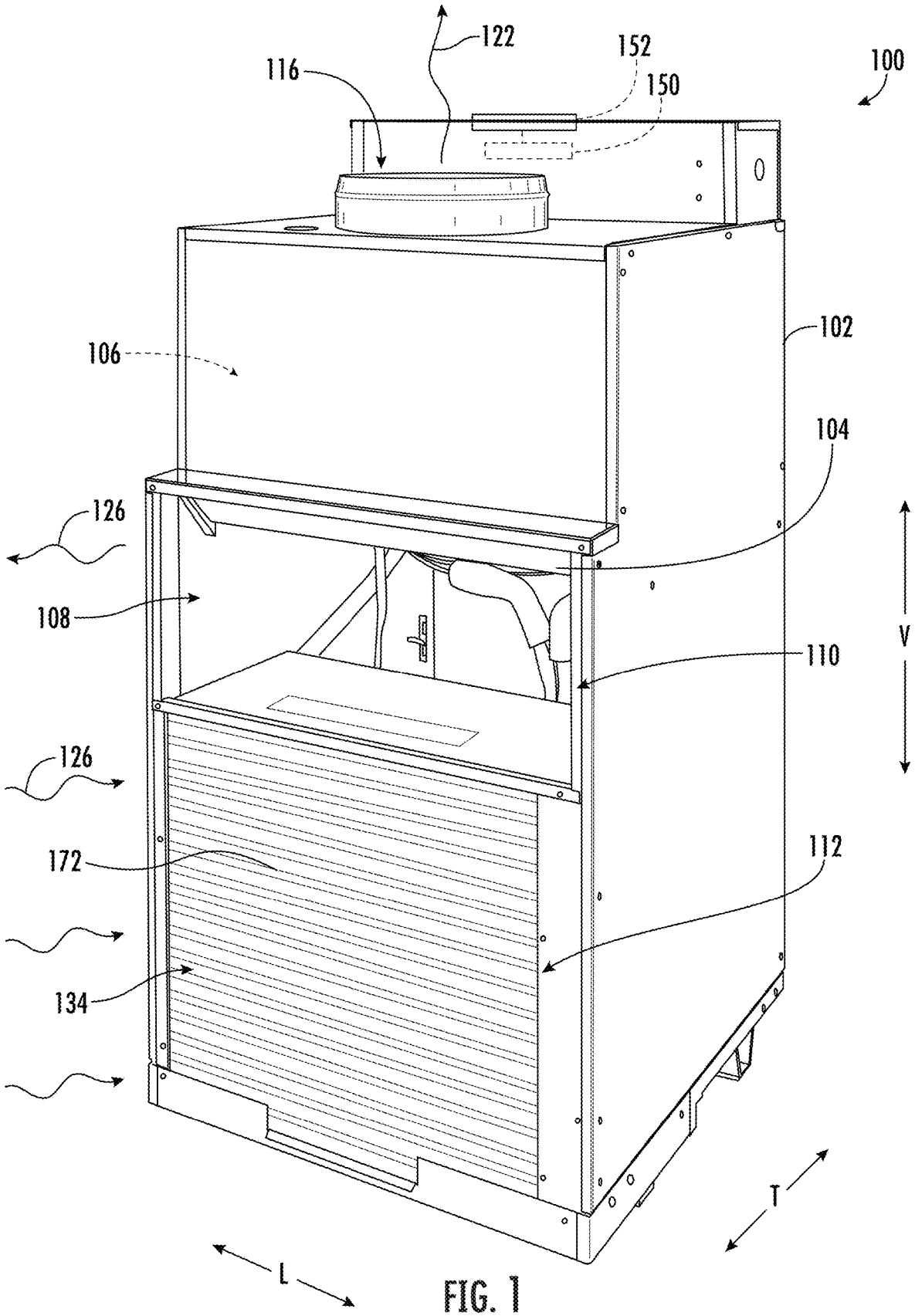
FIG. 1 provides a rear perspective view of an air conditioning appliance according to an example embodiment of the present subject matter.
Figure 2:
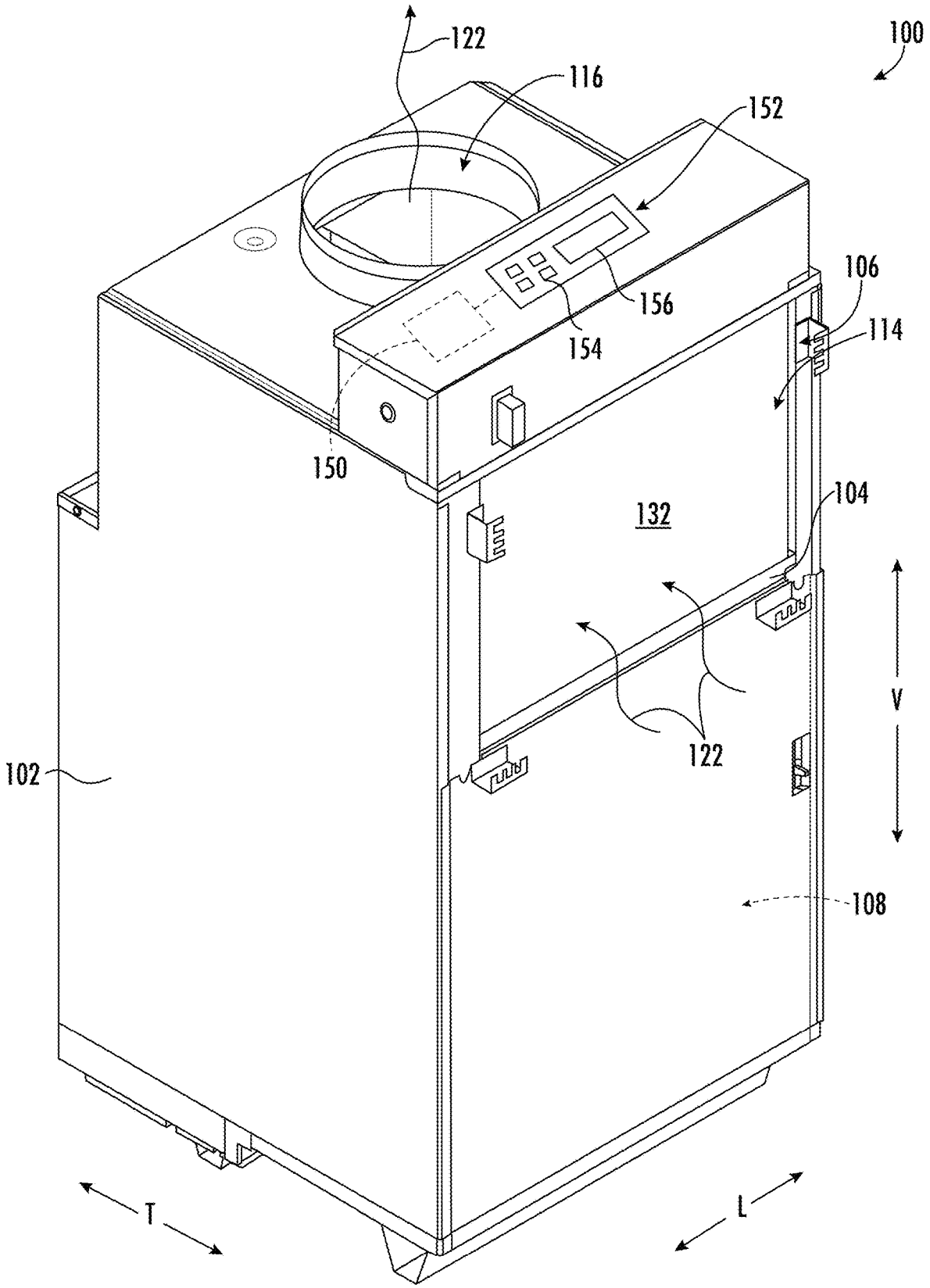
FIG. 2 provides a front perspective view of the example air conditioning appliance of FIG. 1 according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Turning now to the figures, FIGS. 1 through 4 illustrate an exemplary air conditioner appliance (e.g., air conditioner 100). As shown, air conditioner 100 may be provided as a one-unit type air conditioner 100, such as a single-package vertical unit (SPVU). However, it should be appreciated that aspects of the present subject matter may be used with other suitable air conditioning units or air filtering devices, such as a packaged terminal air conditioner unit (PTAC), a split heat pump system, etc. Indeed, variations and modifications to the construction and configuration of air conditioner 100 while remaining within the scope of the present subject matter.

Air conditioner 100 includes a package housing or cabinet 102 for housing and supporting various components of air conditioner 100. Generally, air conditioner 100 or cabinet 102 generally defines a vertical direction V, a lateral direction L, and a transverse direction T. Each direction V, L, T is perpendicular to each other, such that an orthogonal coordinate system is generally defined. According to example embodiments, cabinet 102 may be positioned within a wall sleeve or other suitable structure for supporting air conditioner 100 within a wall of a building.

According to an example embodiment, air conditioner 100 may include a bulkhead 104 that may generally separate and define an indoor portion 106 and an outdoor portion 108 within cabinet 102. According to the illustrated embodiment, bulkhead 104 extends substantially within a horizontal plane (e.g., defined by the lateral direction L and the transverse direction T), and indoor portion 106 may be positioned at least partially above outdoor portion 108 along the vertical direction V. However, it should be appreciated that other orientations of bulkhead 104 may be used and the relative positioning of indoor portion 106 and outdoor portion 108 may be varied while remaining within the scope of the present subject matter.

In some embodiments, cabinet 102 contains various other components of the air conditioner 100 and may define airflow paths to facilitate heat exchange and conditioning of the indoor space. In this regard, cabinet 102 may define an outdoor inlet 110 and an outdoor outlet 112 on the back side of cabinet 102. In addition, cabinet 102 may define an indoor inlet 114 and an indoor outlet 116 on the front side of cabinet 102. According to example embodiments, some or all of outdoor inlet 110, outdoor outlet 112, indoor inlet 114, and/or indoor outlet 116 may be configured for receiving a grill, grate, or another suitable covering. Furthermore, one or more air filters may be positioned within the flow paths for filtering dust, debris, pathogens, or other particulates from the respective air flows.

During certain operations, air conditioner 100 may use one or more fans to urge flows of air throughout indoor portion 106 and outdoor portion 108. In this regard, for example, air conditioner 100 may include an indoor fan 120 that is selectively operated to urge a flow of indoor air (e.g., identified generally by reference numeral 122) through indoor portion 106. Similarly, air conditioner 100 may include an outdoor fan 124 that is selectively operated to urge a flow of outdoor air (e.g., identified generally by reference numeral 126) through outdoor portion 108.

According to example embodiments, indoor fan 120 and outdoor fan 124 may have any suitable size, positioning, and configuration. For example, indoor fan 120 and/or outdoor fan 124 may be centrifugal fans, axial fans, tangential fans, etc. In addition, it should be appreciated that indoor fan 120 and outdoor fan 124 may be variable speed fans that may rotate at different rotational speeds, thereby generating different air flow rates. Other variations are possible and within the scope of the present subject matter.

Notably, air conditioner 100 may further include a heat exchanger assembly 130 that is generally configured to transfer thermal energy between the flow of indoor air 122 and the flow of outdoor air 126. In this regard, for example, heat exchanger assembly 130 may generally include an indoor heat exchanger 132 positioned within indoor portion 106 and an outdoor heat exchanger 134 positioned within outdoor portion 108. Although example heat exchanger constructions and configurations are described herein, it should be appreciated that variations to heat exchanger assembly 130 are possible and within the scope of the present subject matter.

Indoor heat exchanger 132 and outdoor heat exchanger 134 may be components of a thermodynamic assembly (i.e., sealed system), which may be operated as a refrigeration assembly (and thus perform a refrigeration cycle) or, in the case of the heat pump unit embodiment, a heat pump (and thus perform a heat pump cycle). Thus, as is understood, exemplary heat pump unit embodiments may be selectively operated perform a refrigeration cycle at certain instances (e.g., while in a cooling mode) and a heat pump cycle at other instances (e.g., while in a heating mode). By contrast, exemplary A/C exclusive unit embodiments may be unable to perform a heat pump cycle (e.g., while in the heating mode), but still perform a refrigeration cycle (e.g., while in a cooling mode).

The sealed system may, for example, further include compressor 140 and an expansion device (e.g., expansion valve or capillary tube—not pictured), both of which may be in fluid communication with the heat exchangers 132, 134 to flow refrigerant therethrough, as is generally understood. According to an example embodiment, compressor 140 may be a variable speed compressor. In this regard, compressor 140 may be operated at various speeds depending on the current air conditioning needs of the room and the demand on the sealed system. For example, according to an exemplary embodiment, compressor 140 may be configured to operate at any speed between a minimum speed, e.g., 1500 revolutions per minute (RPM), to a maximum rated speed, e.g., 3500 RPM. Notably, the use of variable speed compressor 140 enables efficient operation of the sealed system, minimizes unnecessary noise when compressor 140 does not need to operate at full speed, and ensures a comfortable environment within the room.

The operation of air conditioner 100 including compressor 140 (and thus the sealed system generally), indoor fan 120, outdoor fan 124, one or more auxiliary heating units (not shown), and other suitable components may be controlled by a control board or controller 150. Controller 150 may be in communication (via for example a suitable wired or wireless connection) to such components of the air conditioner 100. By way of example, the controller 150 may include a memory and one or more processing devices such as microprocessors, CPUs or the like, such as general or special purpose microprocessors operable to execute programming instructions or micro-control code associated with operation of air conditioner 100. The memory may be a separate component from the processor or may be included onboard within the processor. The memory may represent random access memory such as DRAM, or read only memory such as ROM or FLASH.

Air conditioner 100 may additionally include a control panel 152 and one or more user inputs 154, which may be included in control panel 152. The user inputs 154 may be in communication with the controller 150. A user of the air conditioner 100 may interact with the user inputs 154 to operate the air conditioner 100, and user commands may be transmitted between the user inputs 154 and controller 150 to facilitate operation of the air conditioner 100 based on such user commands. A display 156 may additionally be provided in control panel 152 and may be in communication with the controller 150. Display 156 may, for example be a touchscreen or other text-readable display screen, or alternatively may simply be a light that can be activated and deactivated as required to provide an indication of, for example, an event or setting for the air conditioner 100.

During certain operations, indoor air 122 may be drawn to indoor portion 106 through indoor inlet 114, e.g., as motivated by indoor fan 120. At least a portion of the indoor air 122 may be motivated through or across indoor heat exchanger 132 and/or across a heating unit (not shown) before being returned to the indoor area of the room through indoor outlet 116 defined through cabinet 102. Optionally, one or more conduits (not pictured) may be mounted on or downstream from indoor outlet 116 to further guide indoor air 122 from air conditioner 100. It is noted that although indoor outlet 116 is illustrated as generally directing air upward, it is understood that indoor outlet 116 may be defined in alternative embodiments to direct air in any other suitable direction.

Moreover, at least a portion of the outdoor air 126 may be motivated through or across outdoor heat exchanger 134, e.g., being drawn in through outdoor inlet 110 and being passed out of outdoor outlet 112 under motivation of outdoor fan 124. It is noted that although outdoor inlet 110 is illustrated as being defined above outdoor outlet 112, alternative embodiments may reverse this relative orientation (e.g., such that outdoor inlet 110 is defined below outdoor outlet 112) or provide outdoor inlet 110 beside outdoor outlet 112 in a side-by-side orientation, or another suitable orientation. Other configurations are possible and within the scope of the present subject matter.

In certain embodiments, one or more components of outdoor portion 108 are mounted to cabinet, e.g., on a base pan 160, as shown. According to exemplary embodiments, base pan 160 may be a substantially rigid, horizontal structure configured for supporting various components. In addition, base pan 160 may be configured for collecting or directing condensation (e.g., identified herein generally by reference numeral 162) that tends to form on one or both of indoor heat exchanger 132 and outdoor heat exchanger 134. As will be explained in more detail herein, condensation 162 may be used to improve the heat transfer efficiency of heat exchanger assembly 130 and the operation of air conditioner 100.

Figure 5:
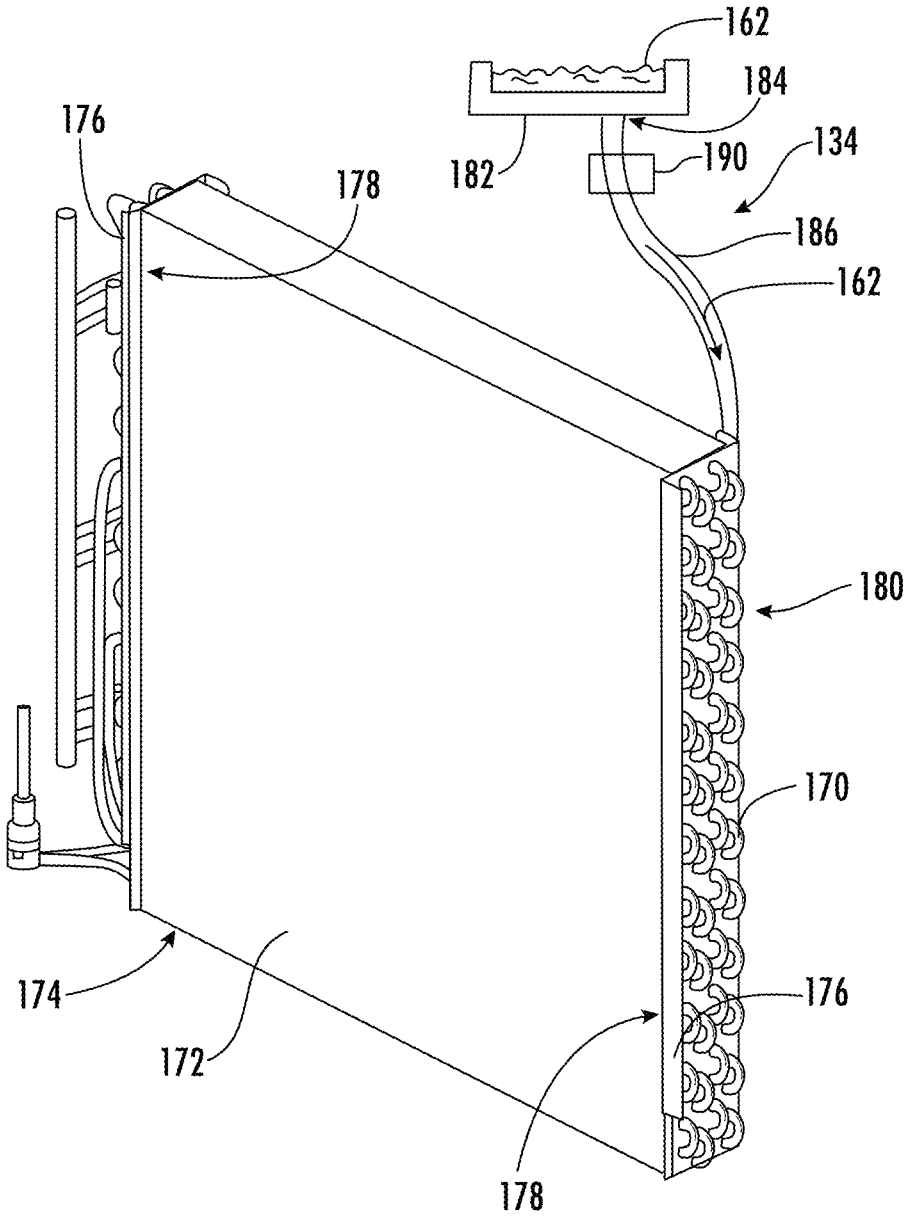
FIG. 5 provides a perspective view of a heat exchanger of the example air conditioning appliance of FIG. 1 according to an example embodiment of the present subject matter.

Referring now generally to FIGS. 1 through 6, heat exchanger assembly 130 will be described in more detail according to an example embodiment of the present subject matter. Although an example construction of outdoor heat exchanger 134 is illustrated in FIG. 5 and described herein, it should be appreciated that indoor heat exchanger 132 may have the same or similar construction. It should be appreciated that the present subject matter is not limited to the specific instructions and manufacturing methods described herein.

As illustrated, outdoor heat exchanger 134 may generally include an outdoor coil 170 through which refrigerant of the sealed system passes to transfer thermal energy between indoor heat exchanger 132 and outdoor heat exchanger 134. In this regard, outdoor coil 170 may be a conduit formed from a suitably conductive material (e.g., such as copper) that may wind back and forth through outdoor heat exchanger 134 along various passes. In addition, outdoor heat exchanger 134 may include a plurality of heat exchange fins 172 or other structures for enhancing heat exchange between the refrigerant passing through outdoor coil 170 and the flow of outdoor air 126.

For example, heat exchange fins 172 may be embodied as a fin pack 174 which is a substantially rectangular structure through which the flow of outdoor air 126 passes to facilitate heat exchange. According to example embodiments, heat exchange fins 172 may be brazed or otherwise attached and thermally coupled to outdoor coil 170. Moreover, according to the illustrated embodiment, fin pack 174 may include a pack mounting bracket 176 on each lateral side 178 of fin pack 174. As illustrated, between each pass of outdoor coil 170, an exposed portion 180 of outdoor coil 170 may extend through pack mounting bracket 176 to form a U-bend or turn in outdoor coil 170. In this regard, exposed portions 180 are generally not covered directly by heat exchange fins 172 and may generally extend out each side 178 of fin pack 174 to form the lateral sides of outdoor heat exchanger 134.

In addition, according to an example embodiment, outdoor fan 124 is configured for directing the flow of outdoor air 126 through fin pack 174. However, exposed portions 180 of outdoor coil 170 may generally be protected from or held outside the flow of outdoor air 126, e.g., via pack mounting brackets 176, a fan shroud, or other structures. Notably, this construction may prevent condensate 162 from being blown off exposed portions 180 as described in more detail below according to an example embodiment.

Notably, as explained briefly above, condensate 162 may be used to improve the heat exchange efficiency of a heat exchanger, such as outdoor heat exchanger 134. Accordingly, aspects of the present subject matter are directed to the efficient and effective use of condensate 162. In this regard, air conditioner 100 may include a condensate collection pan 182 that is positioned under indoor heat exchanger 132 for collecting condensate 162. In this regard, during operation of sealed system, indoor heat exchanger 132 may have a tendency to generate a large amount of condensate 162 that may drip down and collect within condensate collection pan 182. According to example embodiments, this collected condensate 162 may be directed onto exposed portions 180 of outdoor coil 170. Notably, by directing condensate 162 directly onto exposed portions 180, heat exchange efficiency may be increased without risking clogging fin pack 174 or blowing condensate 162 out of outdoor heat exchanger 134.

For example, according to the illustrated embodiment, condensate collection pan 182 may be defined at least in part by a bulkhead 104. According to alternative embodiments, condensate collection pan 182 may be a separate structure positioned adjacent indoor heat exchanger 132. As shown, indoor heat exchanger 132 may be positioned at least partially above outdoor heat exchanger 134 along the vertical direction V and condensate 162 may be gravity fed onto exposed portions 180 of outdoor coil 170. According to the illustrated embodiment, condensate collection pan 182 may be positioned entirely above outdoor heat exchanger 134 such that gravity alone may be used to direct condensate 162 onto exposed portions 180.

Figure 6:
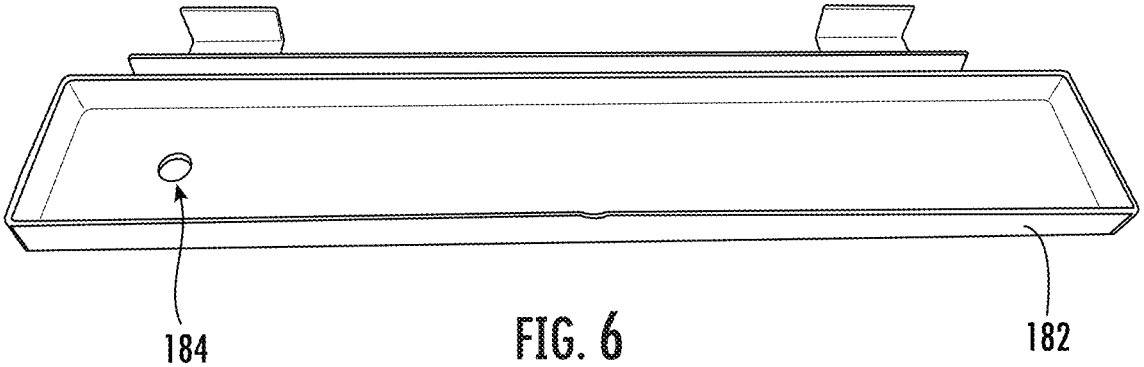
FIG. 6 provides a top perspective view of a condensate collection pan of the example air conditioning appliance of FIG. 1 according to an example embodiment of the present subject matter.

According to the illustrated embodiment, as best illustrated in FIG. 6, condensate collection pan 182 may define at least one drain hole 184 through which condensate 162 may be discharged onto exposed portions 180. According to an example embodiment, drain hole 184 may be positioned directly above exposed portions 180. According to an alternative embodiment, condensate collection pan 182 may define two drain holes 184, each drain hole 180 for being associated with a respective side of outdoor coil 170.

Figure 3:
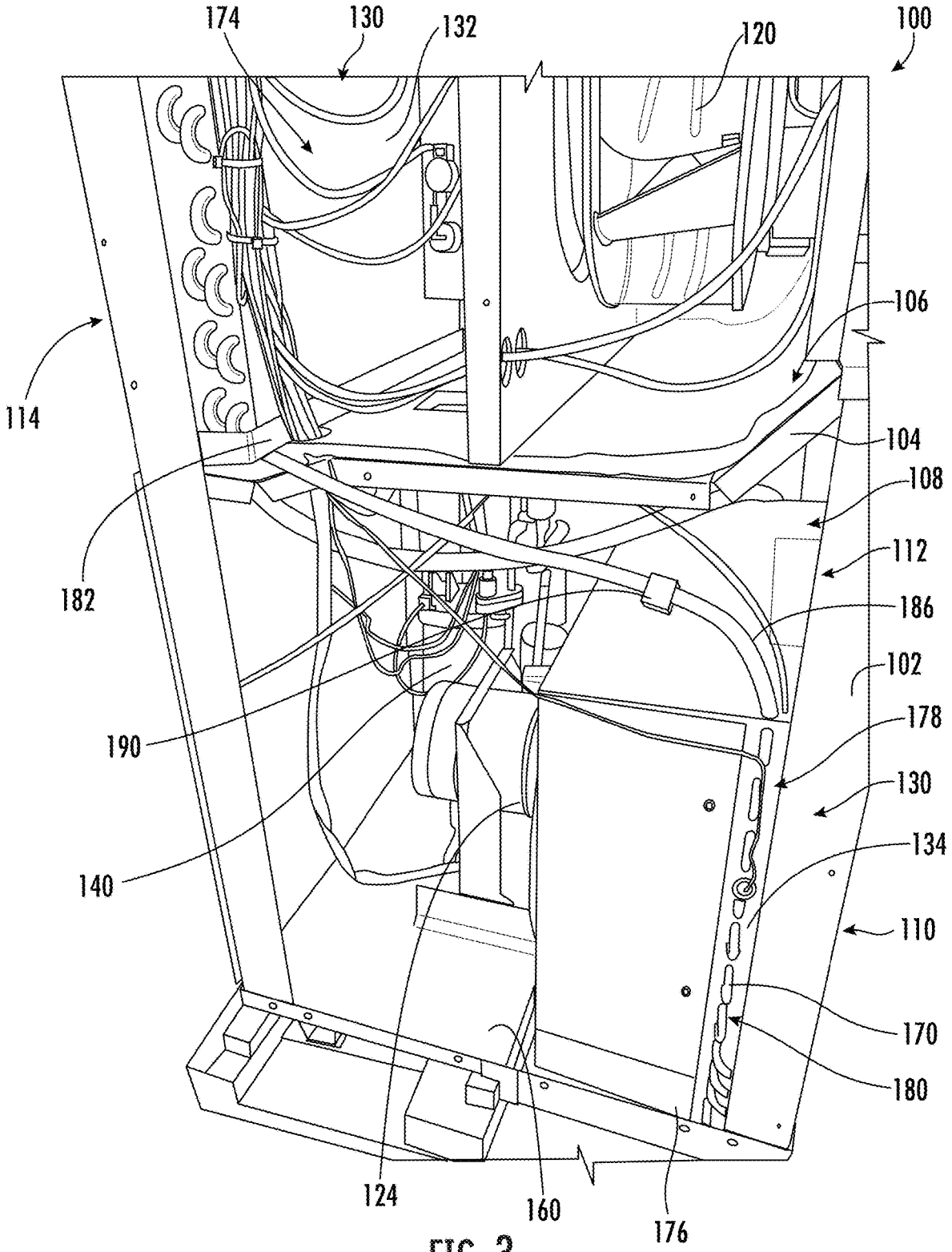
FIG. 3 provides a perspective view of the example air conditioning appliance of FIG. 1 with a portion of a cabinet removed according to an example embodiment of the present subject matter.
Figure 4:
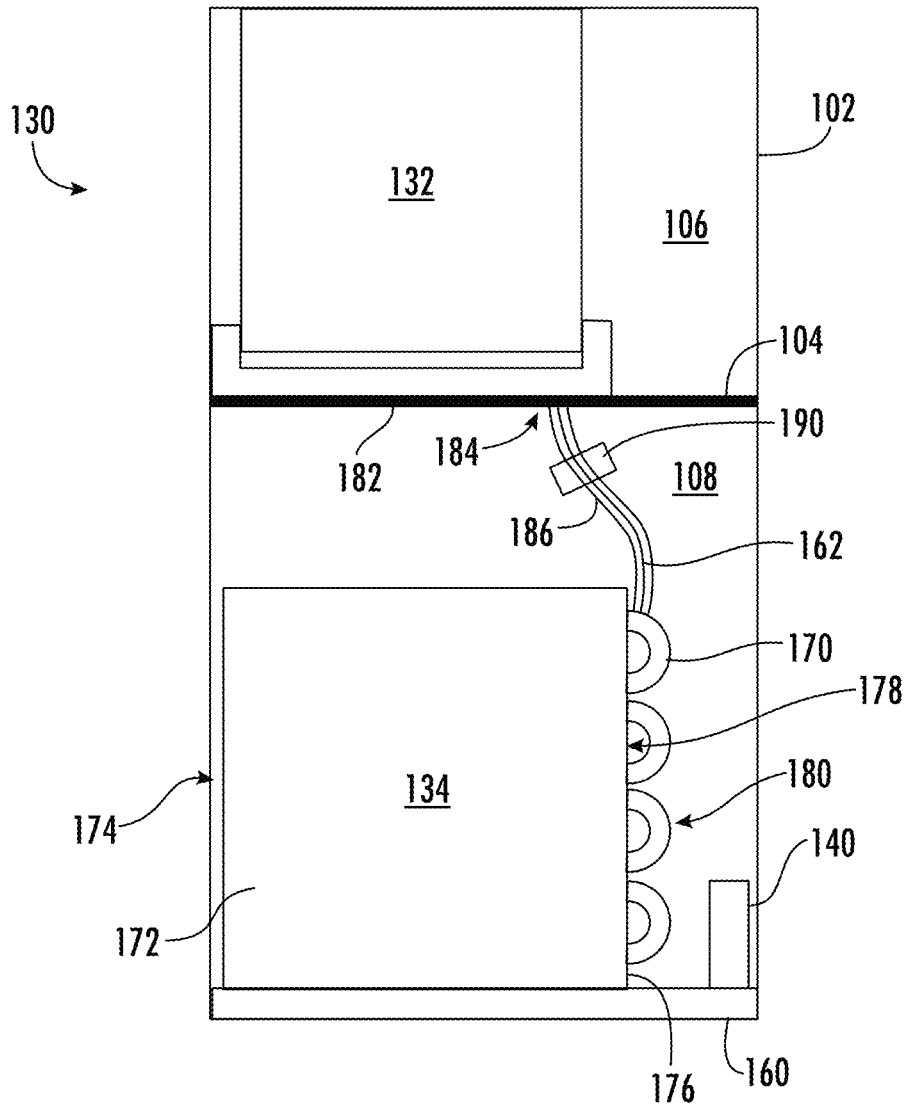
FIG. 4 provides a front schematic view of the example air conditioning appliance of FIG. 1 according to an example embodiment of the present subject matter.

As shown for example in FIG. 3, condensate collection pan 182 may not be positioned directly over outdoor heat exchanger 134. According to such an embodiment, air conditioner unit 100 may further include a hose or conduit 186 that is connected to drain hole 184 for directing condensate 162 directly onto exposed portions 180 of outdoor coil 170. According to still other embodiments, air conditioner 100 may include a pump (e.g., identified schematically in FIG. 6 by reference numeral 190) that is fluidly coupled to condensate collection pan 182 and/or conduit 186 for selectively pumping condensate 162 onto exposed portions 180.

Notably, the collection and redirection of condensate 162 onto exposed portions 180 may improve the thermal efficiency of outdoor heat exchanger 134, reduce the likelihood of clogging fin pack 176, and may eliminate the unintentional discharge of condensate 162 under the force of outdoor fan 124. In addition, base pan 160 may be configured to collect the condensate 162 after it has dripped down all of the exposed portion 180 of outdoor coil 170. The collected condensate may then be slung by outdoor fan 124 (e.g., using a slinger ring attached thereto) to further enhance the heat exchange efficiency of heat exchanger assembly 130.

As explained herein, aspects of the present subject matter are generally directed to a condensate drain system for a vertical air conditioner using an indoor evaporator and a fan assembly at the top section, and an outdoor condenser and a fan assembly at the bottom section. For example, the water from evaporative condensation may drain onto an outer hairpin and other sections of the outdoor coil where the air flow is not necessarily directed. The water acts to add latent energy into the hairpins of the outdoor coil as well as collect directly into a drain pan where it is reapplied as an efficiency aid via outdoor fan sling ring.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit defining a vertical, a lateral, and a transverse direction, the air conditioner unit comprising:

a bulkhead mounted within a cabinet to define an indoor portion and an outdoor portion;

an indoor heat exchanger positioned within the indoor portion;

an outdoor heat exchanger positioned within the outdoor portion, the outdoor heat exchanger comprising an outdoor coil and a plurality of heat exchange fins thermally coupled to the outdoor coil, wherein an exposed portion of the outdoor coil is not covered by the plurality of heat exchange fins; and a condensate collection pan positioned under the indoor heat exchanger for collecting condensate, wherein the condensate is directed onto the exposed portion of the outdoor coil and not onto the plurality of heat exchange fins.

2. The air conditioner unit of claim 1, wherein the indoor heat exchanger is positioned at least partially above the outdoor heat exchanger along the vertical direction and the condensate is gravity-fed onto the exposed portion of the outdoor coil.

3. The air conditioner unit of claim 1, wherein the condensate collection pan is defined by the bulkhead.

4. The air conditioner unit of claim 1, wherein the condensate collection pan defines at least one drain hole for discharging the condensate.

5. The air conditioner unit of claim 4, further comprising:

a hose or conduit connected to the at least one drain hole for directing the condensate onto the exposed portion of the outdoor coil.

6. The air conditioner unit of claim 1, further comprising:

a pump fluidly coupled to the condensate collection pan for urging the condensate onto the exposed portion of the outdoor coil.

7. The air conditioner unit of claim 1, wherein the exposed portion of the outdoor coil is a U-bend defined on a side of the outdoor heat exchanger.

8. The air conditioner unit of claim 1, wherein the exposed portion is defined on both sides of outdoor heat exchanger.

9. The air conditioner unit of claim 1, wherein the plurality of heat exchange fins is embodied as a fin pack, the outdoor heat exchanger further comprising:

a pack mounting bracket positioned on a side of the fin pack, wherein the exposed portion of the outdoor coil passes through the pack mounting bracket.

10. The air conditioner unit of claim 1, further comprising:

an outdoor fan, wherein the outdoor fan is positioned over the heat exchanger fins and does not direct a flow of air over the exposed portion of the outdoor coil.

11. The air conditioner unit of claim 1, further comprising:

a base pan positioned under the outdoor heat exchanger, wherein the condensate drips off outdoor coil and collects in base pan.

12. The air conditioner unit of claim 1, wherein the air conditioner unit is a single package vertical unit, a vertical terminal air conditioner unit, or a packaged terminal air conditioner unit.

13. A heat exchanger assembly for an air conditioner unit, the air conditioner unit defining a vertical, a lateral, and a transverse direction and comprising a bulkhead mounted defining an indoor portion and an outdoor portion, the heat exchanger assembly comprising:

an indoor heat exchanger positioned within the indoor portion;

an outdoor heat exchanger positioned within the outdoor portion, the outdoor heat exchanger comprising an outdoor coil and a plurality of heat exchange fins thermally coupled to the outdoor coil, wherein an exposed portion of the outdoor coil is not covered by the plurality of heat exchange fins; and a condensate collection pan positioned under the indoor heat exchanger for collecting condensate, wherein the condensate is directed onto the exposed portion of the outdoor coil and not onto the plurality of heat exchange fins.

14. The heat exchanger assembly of claim 13, wherein the indoor heat exchanger is positioned at least partially above the outdoor heat exchanger along the vertical direction and the condensate is gravity-fed onto the exposed portion of the outdoor coil.

15. The heat exchanger assembly of claim 13, wherein the condensate collection pan is defined by the bulkhead.

16. The heat exchanger assembly of claim 13, wherein the condensate collection pan defines at least one drain hole for discharging the condensate.

17. The heat exchanger assembly of claim 16, further comprising:

a hose or conduit connected to the at least one drain hole for directing the condensate onto the exposed portion of the outdoor coil.

18. The heat exchanger assembly of claim 13, wherein the exposed portion of the outdoor coil is a U-bend defined on both sides of the outdoor heat exchanger.

19. The heat exchanger assembly of claim 13, wherein the plurality of heat exchange fins is embodied as a fin pack, the outdoor heat exchanger further comprising:

a pack mounting bracket positioned on a side of the fin pack, wherein the exposed portion of the outdoor coil passes through the pack mounting bracket.

20. The heat exchanger assembly of claim 13, further comprising:

an outdoor fan, wherein the outdoor fan is positioned over the heat exchanger fins and does not direct a flow of air over the exposed portion of the outdoor coil.

* * * * *